US005184151A

United States Patent [19]

Ono et al.

[11] Patent Number: 5,184,151

[45] Date of Patent: Feb. 2, 1993

[54] THERMAL TRANSFER RECORDING APPARATUS AND FACSIMILE APPARATUS

[75] Inventors: Takeshi Ono, Yokohama; Takehiro Yoshida, Tokyo; Satoshi Wada, Kawasaki; Tomoyuki Takeda, Yokohama; Masaya Kondo, Tokyo; Makoto Kobayashi, Tama; Takahiro Kato; Takashi Awai, both of Yokohama; Yasushi Ishida, Tokyo; Akihiro Tomoda, Yokohama; Minoru Yokoyama, Yokohama; Masakatsu Yamada, Yokohama, all of Japan

[73] Assignee: Canon Kabushiki Kaisha, Tokyo, Japan

[21] Appl. No.: 648,861

[22] Filed: Jan. 31, 1991

[30] Foreign Application Priority Data

Feb. 5, 1990 [JP] Japan ..... 2-024403

[51] Int. Cl.[5] ..... B41J 17/00; B41J 33/00

[52] U.S. Cl. ..... 346/76 PH; 400/232; 400/224,2; 400/120; 400/224.1

[58] Field of Search ..... 346/76 PH; 400/120, 400/232, 223, 224, 224.1, 224.2; 358/296

[56] References Cited

U.S. PATENT DOCUMENTS 4,456,392 6/1984 Nozaki et al. ..... 400/120
4,717,967 1/1988 Yoshida ..... 358/296

FOREIGN PATENT DOCUMENTS 0295953 12/1987 European Pat. Off. .
57-83471 5/1982 Japan .
6258917 1/1983 Japan .
58-201686 11/1983 Japan .

*Primary Examiner*—Joseph W. Hartary
*Assistant Examiner*—Huan Tran
*Attorney, Agent, or Firm*—Fitzpatrick, Cella, Harper & Scinto

[57] ABSTRACT

A thermal transfer recording apparatus, which transfers ink contained on an ink sheet onto a recording medium to record images thereon, and comprises a means for conveying the ink sheet and recording medium; recording means for effecting the ink sheet to record the image on the recording medium; and adjusting means for adjusting the conveyance amount of the ink sheet against the recording medium at the time of starting the next recording action if the recording action is suspended after the unit of a predetermined amount of image data has been recorded by the above-mentioned recording means.

18 Claims, 7 Drawing Sheets

THERMAL TRANSFER RECORDING APPARATUS AND FACSIMILE APPARATUS

BACKGROUND OF THE INVENTION

Field of the Invention

The present invention relates to a thermal transfer recording apparatus and a facsimile apparatus for recording images on recording medium by transferring ink contained in an ink sheet to the aforesaid recording medium.

RELATED BACKGROUND ART

Generally, a thermal transfer printer uses an ink sheet with heat fusible (or heat sublimable) ink coated on the base film thereof, and selectively heats such an ink sheet by energizing the thermal head in response to image signals in order to transfer the fused (or sublimated) ink to a recording sheet for image recording. Usually, an ink sheet of the kind is such formed so that the ink is completely transferred to the recording sheet after one image recording (the so-called one-time sheet). Therefore, it is necessary to convey the ink sheet for an amount equivalent to the length of the recorded character(s) or one line of image after the image recording has been completed, so that the unused portion of the ink sheet should reliably be brought forward to the position for the next recording. Thus the consumption of the ink sheet becomes great and the running cost of the thermal transfer printer tends to be higher than that of a usual thermal printer using thermal sheets for recording.

With a view to solving problems such as this, a thermal transfer printer has been proposed, in which both recording sheet and ink sheet are conveyed in the same direction at different speeds, as disclosed in Japanese Laid-Open Patent Application No. 57-83471 and No. 58-201686 or Japanese Patent Publication No. 62-58917.

As an ink sheet employed for these thermal printers, an ink sheet (multiprint sheet) capable of recording images for plural numbers (n) is known. When a length L of recording is continuously performed using this ink sheet, it is possible to carry on the recording by making the length of the ink sheet to be conveyed after each image recording has been completed or during the image recording shorter than the length L by ($L/n:n>1$). Hence the ink sheet can be used more efficiently than the conventional sheet by n times, and it is therefore expected that the running cost of the thermal transfer printer is lowered. Hereinafter this recording method is referred to as multiprint. An adoption of a multiprint such as this for a facsimile apparatus will be described.

Generally, in a facsimile apparatus, a memory is provided for storing a predetermined amount of received image, so that lines can continuously be recorded up to the maximum storage of the memory. However, if the entire image data for a one-page portion cannot be stored in the memory, the image recording must be suspended after the memory has become full. Then the recording is restarted to record the image data stored in the memory. However, even when the capacity of the memory is large enough, an error, if any generated, causes the image recording to be temporarily suspended, and the recording action becomes intermittent as in the case of recording with block receptions although the image recording can be performed at a high speed unless there is any erroneous line exists.

Therefore, in a case where the image data for a one-page portion cannot be stored in the memory entirely, the recording comes to an abrupt stop, and the recording sheet is transported too for due to the overshoot of the motor for conveying recording sheet, resulting in a possibility that white stripes appear in the reconstructed image which has been recorded. Also, in a period from the suspension of recording action to the reception of data in the next block, and during the period for the recording action to be in a suspended state until the received data is decoded, the molten ink of the ink sheet cools, causing the recording sheet and ink sheet to stick together with the result that white stripes appear due to the irregular transportation of the recording sheet. In addition, if this suspension period of recording action is prolonged, the temperature of thermal mead drops, and there occurs the possibility that the recording density is lower at the starting time of recording the next block.

SUMMARY OF THE INVENTION

An object of the present invention is to provide a thermal transfer recording apparatus and a facsimile apparatus capable of improving the quality of images recorded.

Another object of the present invention is to provide a thermal transfer recording apparatus and a facsimile apparatus, in which the final line of a unit block, which can continuously be recorded in the memory, is detected increase amount by which the ink sheet is conveyed when the first line of the next block is recorded so as to prevent the appearance of white stripes and the lowering of density of the recorded image.

Still another object of the present invention is to provide a thermal transfer recording apparatus and a facsimile apparatus, in which the recording is controlled to perform a recording by a unit of a predetermined amount of image data with recording means for performing image recording on a recording medium by acting on an ink sheet being conveyed by ink sheet conveying means in such a manner as to adjust the amount by which the ink sheet is conveyed against the recording medium at the time of starting the next recording action if the recording action is suspended after the recording has been completed for the unit of the predetermined amount of image data.

A further object of the present invention is to provide a thermal transfer recording apparatus and a facsimile apparatus, in which the image recording is performed on a recording medium by activating an ink sheet being conveyed by ink sheet conveying means after having decoded the received image signals each at the time of receiving a predetermined amount of image signals, and an action is taken to adjust the amount by which the ink sheet is conveyed against the recording medium at the time of starting the next recording action if the recording action is suspended after the recording on the recording medium has been completed for the unit of the predetermined amount of image signals.

DETAILED DESCRIPTION OF THE PREFERRED EMBODIMENTS

Description of a Facsimile Apparatus (FIG. 1–FIG. 4)

Figure 1:
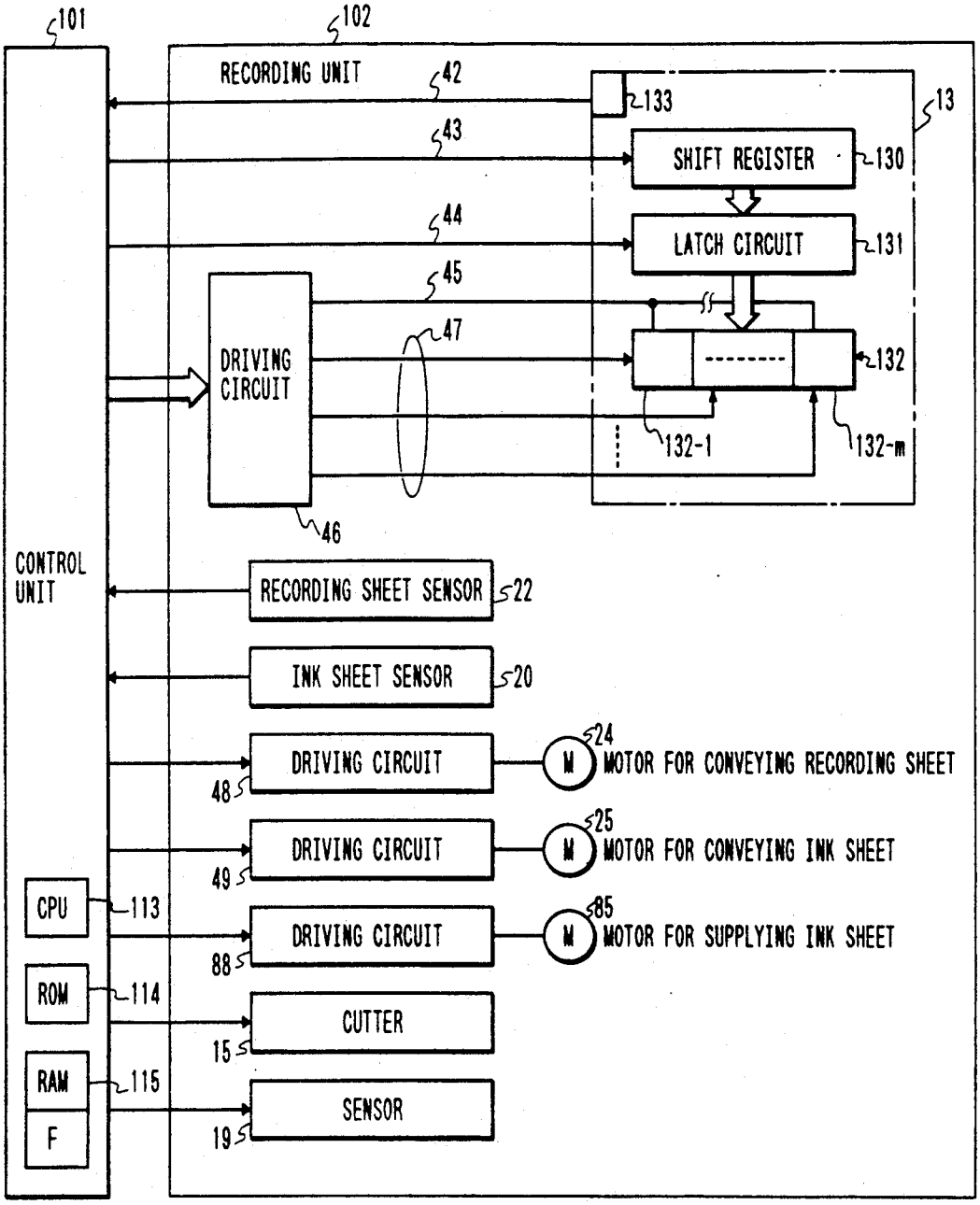
FIG. 1 is a block diagram showing the electrical connection of control unit and recording unit of a facsimile apparatus according to the present embodiment.
Figure 2:
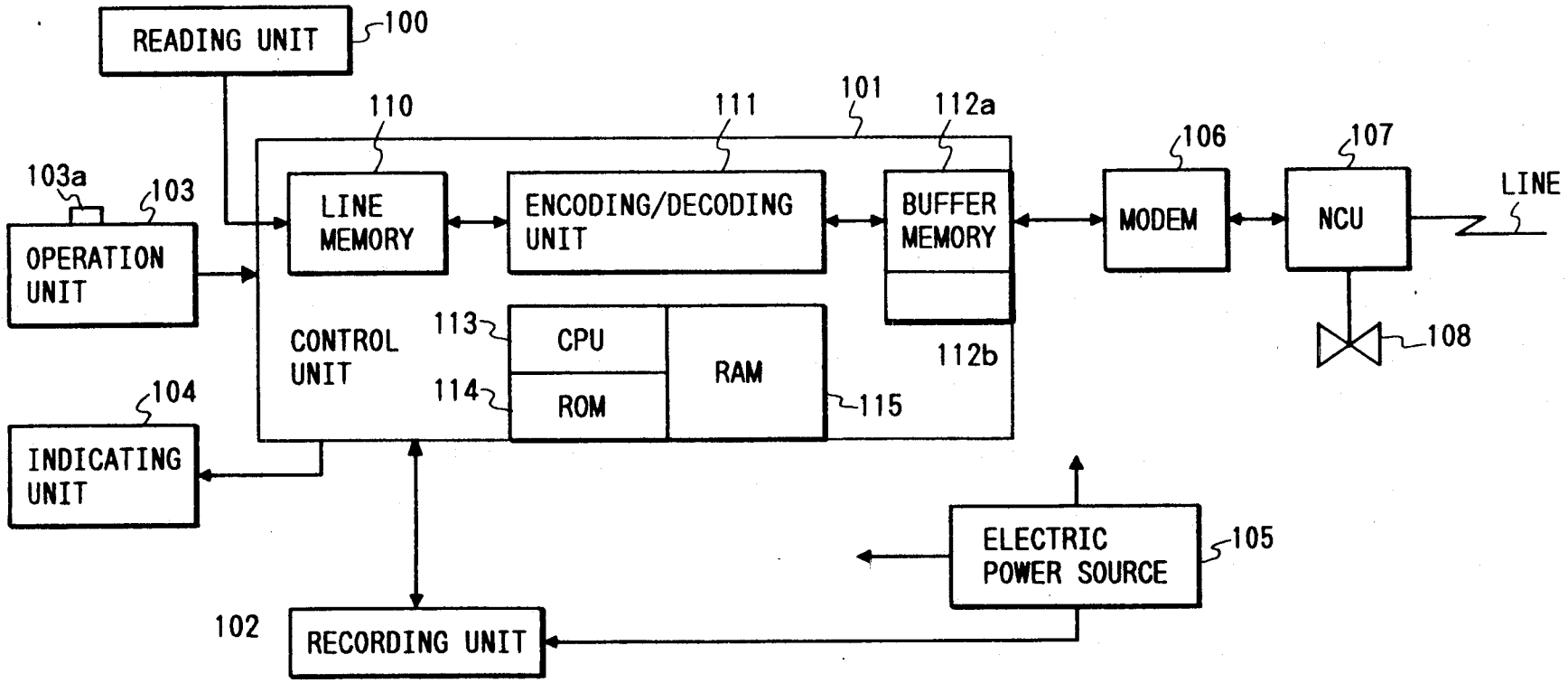
FIG. 2 is a block diagram showing the schematic structure of a facsimile apparatus according to the present embodiment.
Figure 3:
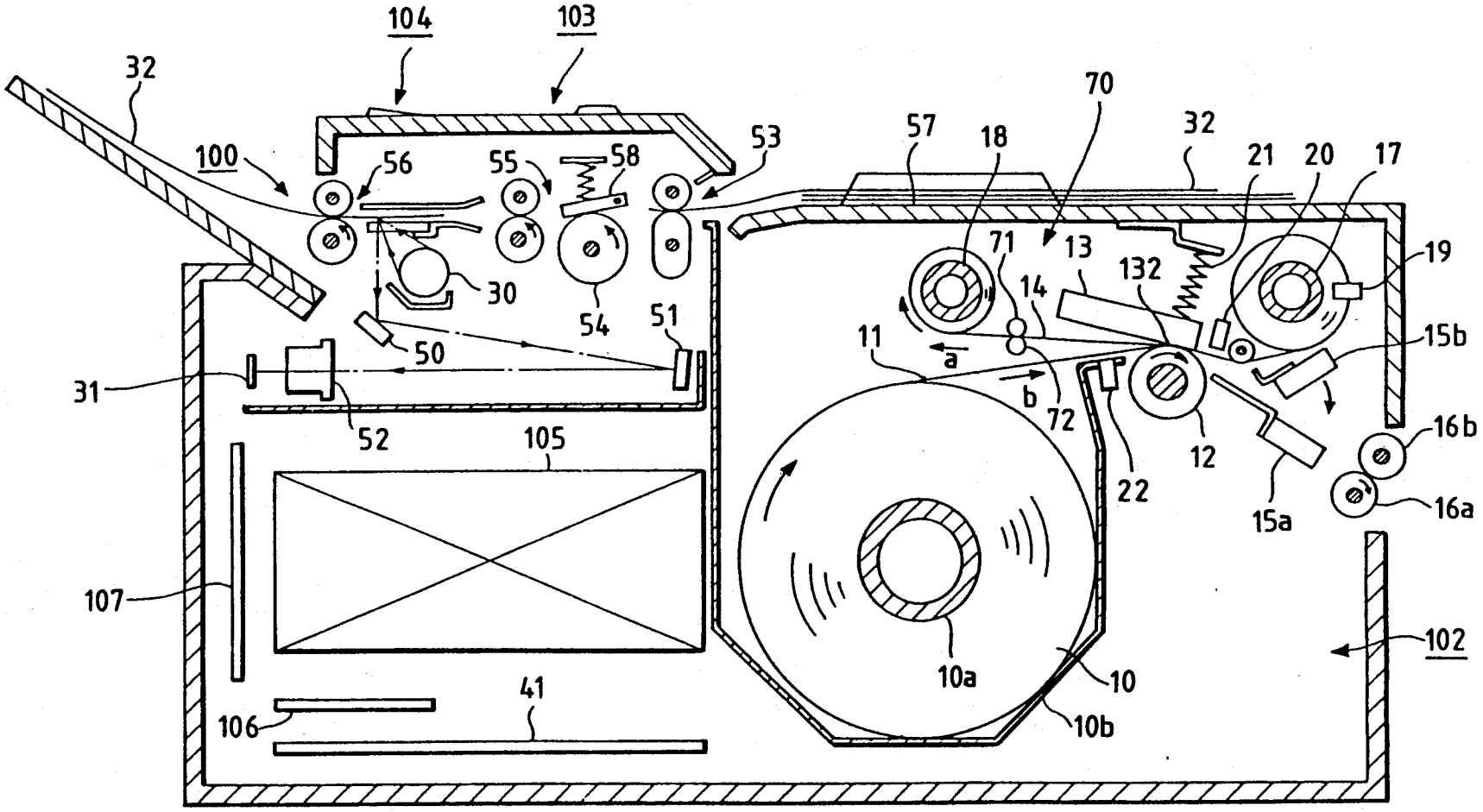
FIG. 3 is a cross-sectional side view showing the mechanical section of a facsimile apparatus according to the present embodiment.
Figure 4:
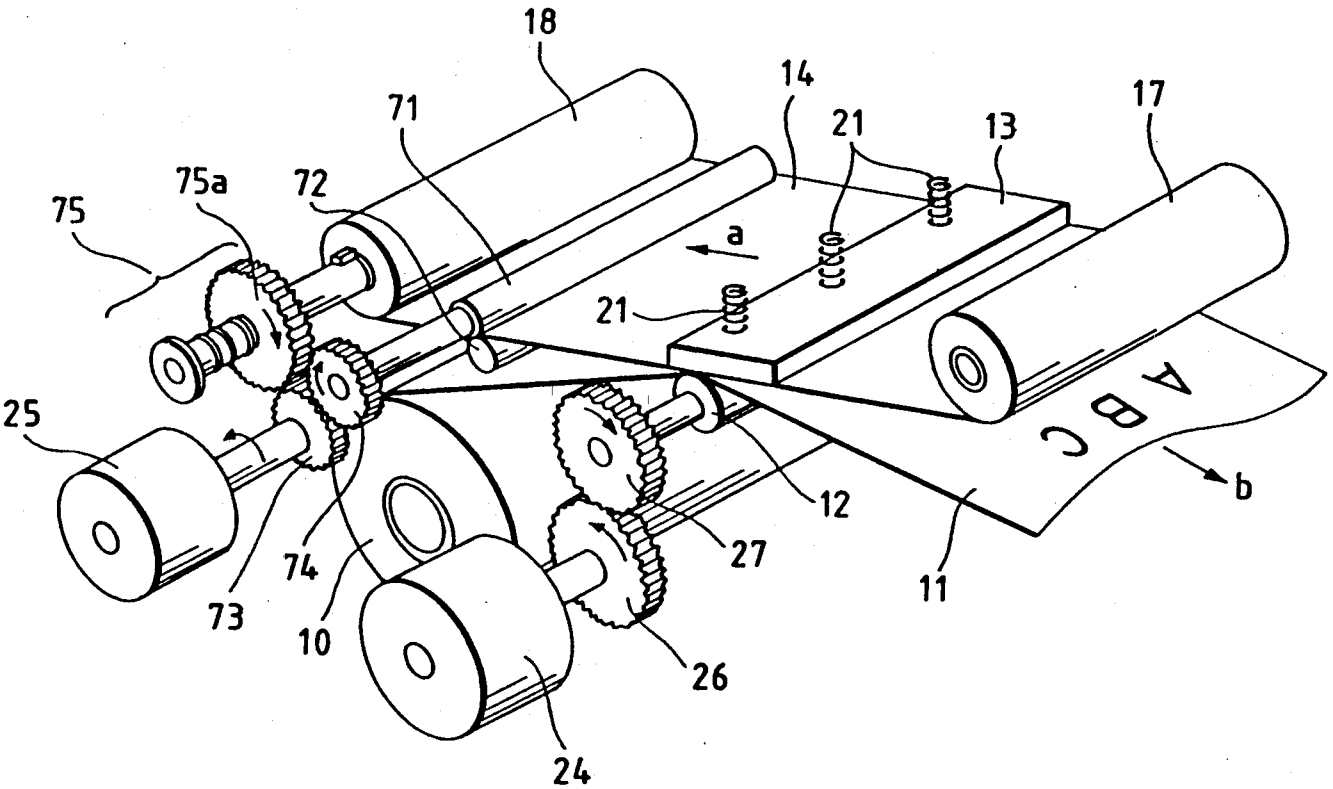
FIG. 4 is a perspective view showing the conveying mechanism for the recording sheet and ink sheet according to the present embodiment.

FIG. 1 to FIG. 4 are views showing an example of a facsimile apparatus to which a thermal transfer printer using an embodiment of the present invention is applied. FIG. 1 illustrates the electrical connection between the control unit 101 and the recording unit 102. FIG. 2 is a block diagram showing the schematic structure of the facsimile apparatus. FIG. 3 is a cross-sectional view of the facsimile apparatus, and FIG. 4 is a view showing the mechanism for conveying recording sheet 11 and the ink sheet 14 in recording unit 102.

At first, the schematic structure described will be that of a facsimile apparatus according to the present embodiment to which the present invention is applied in conjunction with FIG. 2.

In FIG. 2, a numeral 100 denotes a reading unit comprising a motor for conveying original, CCD image sensor, etc. to read an original photoelectrically and output it into control unit 101 as digital image signals. Next, the structure of this control unit 101 is described. A numeral 110 denotes a line memory to store image data from each line of an image data. When the original is transmitted or copied, image data of one-line portion from reading unit 100 is stored, and when image data is received, a one-line portion of the decoded image data is stored therein. Then image formation is performed by outputting the stored data into recording unit 102. A numeral 111 denotes an encoding/decoding unit to encode by MH encoding, etc. image information to be transmitted and at the same time, to decode an encoded image data received and convert it into the image data. Also, a numeral 112 denotes a buffer memory to store encoded image data to be transmitted or received. Here, this memory comprises buffer memories 112*a* and 112*b*, and the image recording is started when either one of the buffer memories becomes full in the course of storage at the time of reception or when the reception of the image for a one-page portion is completed. Then even in the course of this recording action, a received image is being stored in the other buffer memory. This toggle action is repeatedly performed. Each of these units in the control unit 101 is controlled by CPU 113 such as a microprocessor, etc. In the control unit 101, there are provided, in addition to this CPU 113, ROM 114 storing a control program for the CPU 113 and various kinds of data and RAM 115 temporarily storing various kinds of data as working area for the CPU 113, and others.

Numeral 102 denotes a recording unit comprising a thermal line head to record an image on a recording sheet by using the thermal transfer method. This structure will be described later in detail with reference to FIG. 3. Numeral 103 denotes an operation unit including instruction keys for each function such as transmission start, etc., input keys for telephone numbers, and others; 103*a* designates a switch for instructing the kind of ink sheet to be used, which indicates that a multiprint ink sheet is in use when the switch 103*a* is on, and that an ordinary ink sheet is in use when the switch is off; 104 denotes an indication unit usually installed adjacent to the operation unit 103 to display the state of each of the functions, systems, etc.; 105 is a power source to supply electric power to the entire system; 106 is a MODEM (modulator/demodulator); 107 is a network control unit (NCU) for performing automatic receiving by detecting a ringing tone and line control; and 108 is a telephone set.

Next, with reference to FIG. 3, the structure of recording unit 102 is described. Hereinafter features which are common in each of the figures will be designated by the same number.

In FIG. 3, numeral 10 denotes a rolled sheet formed by an ordinary recording sheet 11 which is wound around a core 10*a*. This rolled sheet 10 is stored in the apparatus so that it can freely rotate so that the recording sheet 11 can be supplied to the thermal head unit 13 by the rotation of platen roller 12 in the direction indicated by the arrow. In this respect, numeral 10*b* denotes a rolled sheet housing in which the rolled sheet 10 can detachably be accommodated. Further, numeral 12 denotes a platen roller for conveying the recording sheet 11 in the direction indicated by arrow b and at the same time, for pressing the ink sheet 14 and recording sheet 11 between the platen roller and the heat generating resistor 132 of thermal head 13. The recording sheet 11 is conveyed by the further rotation of platen roller 12 in the direction towards discharge rollers 16 (16*a* and 16*b*) after the image recording has been completed by the heat generation of thermal head 13, and is cut into page lengths by the engagement of cutters 15 (15*a* and 15*b*) when the image recording for the one-page portion is completed.

Numeral 17 denotes an ink sheet supply roller with ink sheet 14 wound thereon. Numeral 18 denotes an ink sheet winding roller driven by a motor for conveying the ink sheet, which will be described later, to take up the ink sheet 14 in the direction indicated by arrow a. In this respect, the ink sheet supply roller 17 and ink sheet winding roller 18 are detachably accommodated in an ink sheet housing 70 in the main body of the apparatus. Further, numeral 19 denotes a sensor for detecting the remaining quantity of ink sheet 14 and the speed at which ink sheet 14 is being conveyed. Also, numeral 20 denotes an ink sheet sensor for detecting the presence of ink sheet 14; 21 is a spring for compressing thermal head 13 against platen roller 12 through recording sheet 11 and ink sheet 14; and 22 is a recording sheet sensor for detecting the presence of the recording sheet.

Subsequently the structure of reading unit 100 will be described.

In FIG. 3, numeral 30 is a light source for irradiating original 32, and the light reflected from original 32 is guided into CCD sensor 31 through an optical system (mirrors 50 and 51, and lens 52), where it is then converted into an electrical signal. The original 32 is conveyed by carrier rollers 53, 54, 55, and 56 driven by a motor (not shown) for conveying the original in accordance with a speed at which the original 32 is being read. In this respect, numeral 57 denotes an original stacker. The plural sheets of originals 32 stacked on this stacker 57 are separated one by one by the cooperation of carrier roller 54 and pressurized separator 58 and conveyed to reading unit 100.

Numeral 41 denotes a control board constituting the major part of control unit 101. From the control board 41 various control signals are output to each of the units in the apparatus. Also, numeral 105 denotes a power source to supply electric power to each unit; 106 is a MODEM board unit; and 107 is an NCU board unit having functions to relay telephone lines.

Further, FIG. 4 is a perspective view showing the details of the mechanism for conveying both ink sheet 14 and recording sheet 11.

In FIG. 4, numeral 24 designates a motor for conveying the recording sheet by rotationally driving platen roller 12 to convey recording sheet 11 in the direction indicated by arrow b which is opposite to the direction indicated by an arrow a. Also, numeral 25 designates a motor for conveying the ink sheet the 14 in the direction indicated by arrow a by rotating capstan roller 71 and pinch roller 72. Further, numerals 26 and 27 are transmission gears for transmit the rotation of motor 24 for conveying the recording sheet to platen roller 12; 73 and 74 are transmission gears that transmit the rotation of motor 25 for conveying ink sheet to capstan roller 71; and 75 is a sliding clutch unit.

Here, by setting the ratio between gears 74 and 75 so as to make the length of the ink sheet 14 taken up by the winding roller 18 driven by the rotation of gear 75*a* longer than the length of the ink sheet conveyed by capstan roller 71, the ink sheet 14 having been conveyed by capstan roller 71 is reliably taken up by winding roller 18. Then, an amount equivalent to the difference between the amount of ink sheet 14 taken up by winding roller 18 and that of ink sheet 14 conveyed by the capstan roller 71 is absorbed by sliding clutch unit 75. In this way, it is possible to restrict variations in the speed or amount of the ink sheet conveyed, which variations may be caused by the changing diameter of winding roller 18 as the winding advances.

Here, in this respect, the structure is so arranged that ink sheet 14 is conveyed by three steps relative to recording sheet 11 being conveyed for one line (1/15.4 mm) for recording, and that the gear ratio is set to establish the amount to convey ink sheet 14 for three steps to be a fifth of the amount to convey recording sheet 11 for one step (n=5). Therefore, if, for example, image recording is performed with n=3, motor 25 for conveying ink sheet should be controlled to rotate for five steps while motor 24 for conveying recording sheet is rotated for one step to convey recording sheet.

FIG. 1 is a diagram showing the electrical connection between control unit 101 and recording unit 102 in a facsimile apparatus according to the present embodiment, and those features also found in the other figures are designated by the same reference number.

The thermal head 13 is a line head. Thermal head 13 comprises a shift register 130 for inputting a one-line portion of the serial recording data from control unit 101 and shift clock 43; a latch circuit 131 for latching data in shift register 130 by latch signal 44; and a heat generating element comprising a heat generating resistor body for one line portion. Here, the heat generating resistor body 132 is divided into m blocks indicated by numerals 132-1 to 132-m for driving.

Also, numeral 133 denotes a temperature sensor installed on thermal head 13 for detecting the temperature of thermal head 13. The output signal 42 of this temperature sensor 133 is inputted into said CPU 113 after an A/D conversion executed in control unit 101. Thus CPU 113 detects the temperature of thermal head 13 and accordingly adjust the amplitude of strobe signal 47 or the driving voltage of thermal head 13 and changes the applied energy to thermal head 13 in accordance with the characteristics of ink sheet 14. Numeral 116 is a programmable timer. Its timing is set by CPU 113, and when the start of timing is instructed, the timer starts timing to actuate CPU 113 to output an interrupt signal, time-out signal, etc. respectively at each time instructed. Thus the period for energizing thermal head 13 and others are determined.

In this respect, the characteristics (kinds) of ink sheet 14 may be determined by the use of the aforesaid switch 103*a* in operation unit 103 or the detection of marks, etc. printed on ink sheet 14, or the detection of marks, cut-off, projection or the like provided for a cartridge, etc.

Numeral 46 is a driving circuit to receive the driving signal for thermal head 13 from control unit 101 to output strobe signal 47 for driving thermal head 13 by the unit of each block. In this respect, the driving circuit 46 enables the applied energy to thermal head 13 to be changed by adjusting the voltage output to source line 45 which supplies electric current to the heat generating element 132 of thermal head 13 in accordance with instructions from control unit 101. Numeral 36 is a driving circuit including a motor for driving cutters 15 for their engagement. Numeral 39 is a motor for rotatably driving discharge sheet rollers 16. Numerals 35, 48 and 49 are motor driving circuits for driving the discharge sheet motor 24 for conveying recording sheet, and the motor 25 for conveying ink sheet respectively. In this respect, these motors 39 for discharging sheet, 24 for conveying the recording sheet, and 25 for conveying the ink sheet are stepping motors in the present embodiment, but these are not limited thereto, and can for example, be DC motors.

Description of Recording Process (FIG. 1–FIG. 5)

Figure 5:
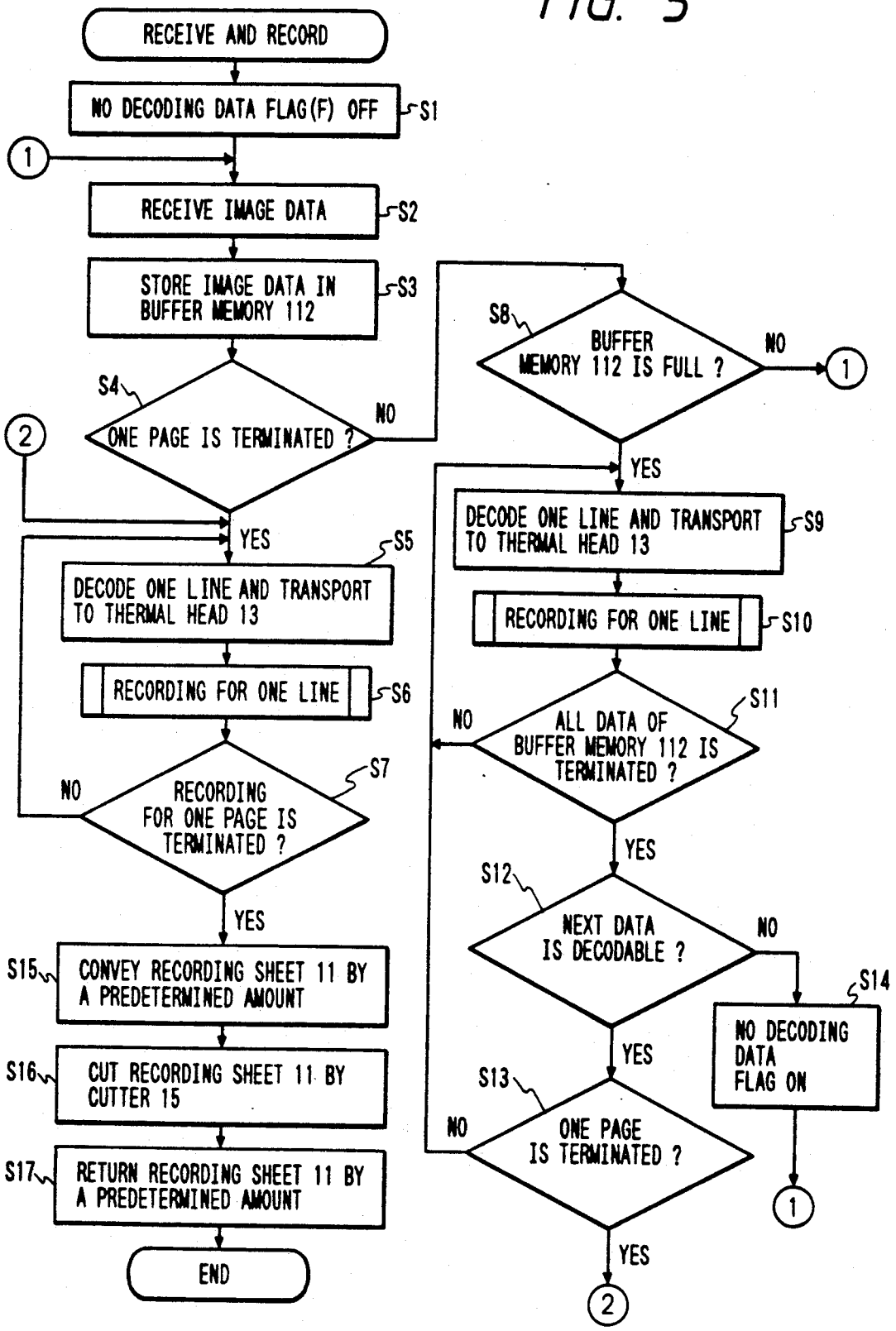
FIG. 5 is a flowchart showing the recording process in a facsimile apparatus according to the present embodiment.

FIG. 5 is a flowchart showing the receiving and recording process in a facsimile apparatus according to the present embodiment. The control program for executing this process is stored in ROM 114 in control unit 101. Here, it is assumed that by means of switch 103*a*, etc. the control unit 101 has already discriminated the installation of a multiprint sheet.

First, at step S1, the flag (F) for indicating no decoding data in RAM 115 is turned off; at step S2, image data transmitted from an equipment on the transmitting side is received; and at step S3, the image data is stored in buffer memory 112*a*. Then at step S4, buffer memory 112*a* is examined to determine whether or not image data for a one-page portion has been stored. When image data for the one-page portion is received, the process proceeds to step S5 to decode the image data for a one-line portion and transport it to shift register 130 of the thermal head 13.

Figure 6:
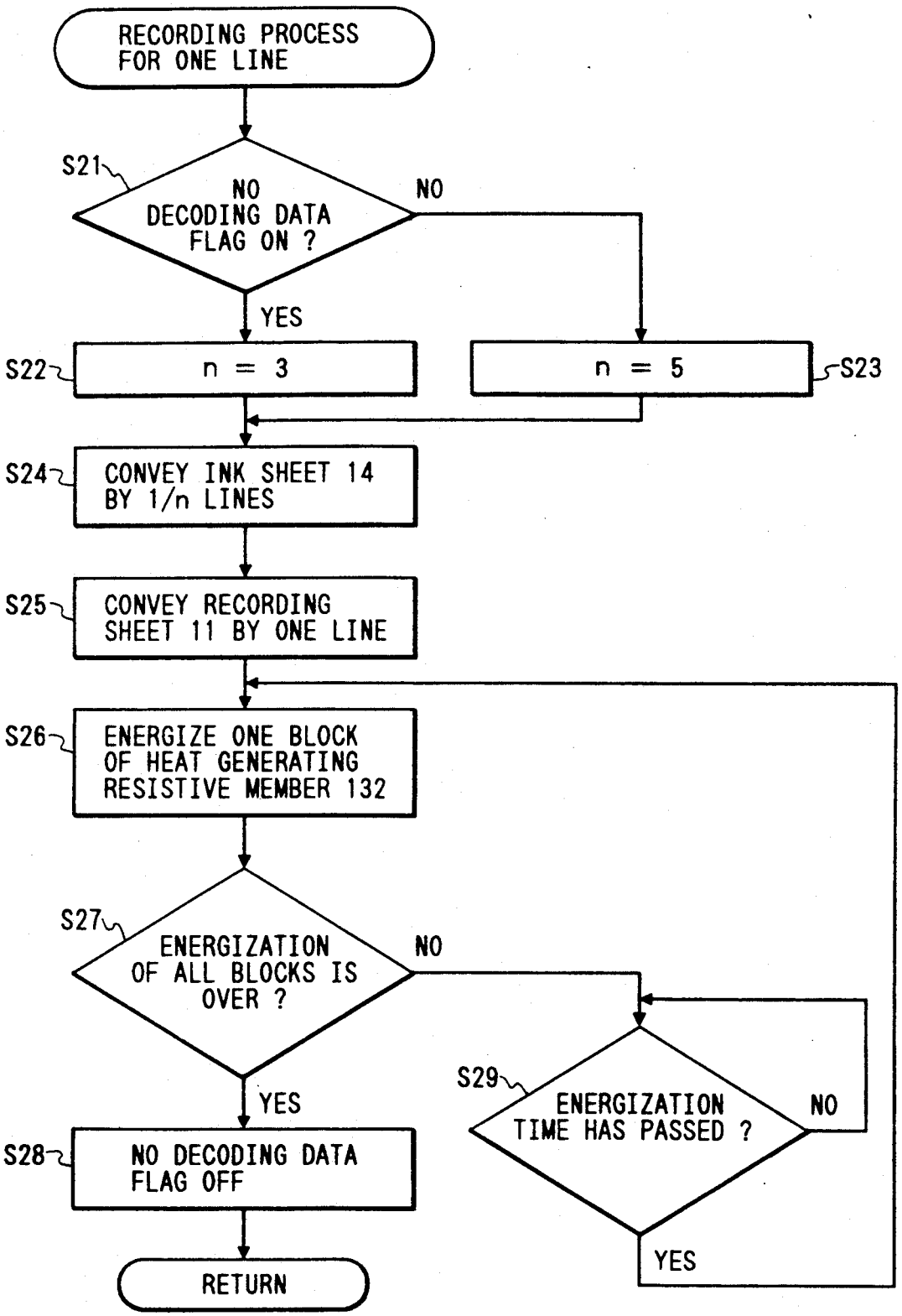
FIG. 6 is a flowchart showing the recording action in a facsimile apparatus according to the present embodiment.

In this way, when the image data for the one-line portion is transported and stored in thermal head 13, the process proceeds to step S6 to execute the one-line recording as represented in the flowchart shown in FIG. 6. When the entire blocks (four blocks) are completely energized at the step S6 to have executed the one-line recording, the process proceeds to step S7 to examine whether or not the recording for the page has been terminated. Then, when the recording for the page is terminated, the process proceeds to a step S15 to transport the recording sheet 11 for predetermined amount in the direction towards same time, to drive cutter 15 (15*a* and 15*b*) into engagement at step S16 to cut the recording sheet into a page length. Then, at the same time that the recording sheet 11 thus cut is discharged by discharge sheet rollers 16 to the outside of the apparatus at step S17, the remaining portion of recording sheet 11 is withdrawn for a distance equivalent to the space between thermal head 13 and cutters 15.

At step S4, if the reception of image data for a one-page portion is not terminated, the process proceeds to a step S8 to examine whether or not buffer memory 112*a* is full. If buffer memory 112*a* is not full, process returns to the step S2 to continuously execute receiving the image data. However, if buffer memory 112*a* is found to be full before the reception of the one page has been terminated, the image data already stored in buffer memory 112*a* is decoded for recording at steps S9 to S11. In this respect, even during such period of the execution, the data is being received without interruption and stored in buffer memory 112*b*.

At step S9, image data for one line is read from buffer memory 112*a* for decoding and is transported to thermal head 13. Thus, at the step S10, image recording for the one line is performed and at the step S11, buffer memory 112*a* is examined to determine whether or not the entire image data stored therein has been decoded. If the entire image data is not decoded for recording, the process returns to step S9 to perform the decoding and recording of the image data.

At those steps S9 to S11, if buffer memory 112*a* becomes memory full for an image data which is currently decoded for recording, the image data being received is sequentially stored in buffer memory 112*b*. In this way, when the entire image data stored in buffer memory 112*a* is decoded for recording at the step S11, process proceeds to step S12 to judge whether or not there is any image data which can be decoded for recording in buffer memory 112*b* in accordance with the state where either buffer memory 112*b* is full and ready for recording or the reception of the one page is terminated at step S13, and if so, the process proceeds to step S5 to read image data from buffer memory 112*b* this time for the execution of the aforesaid recording.

Meanwhile, at step S12, if buffer memory 112*b*, which is executing the reception, is not full, i.e., there is no data for the next image prepared for decoding in buffer memory 112*b*, the process proceeds to step S14 to turn on the flag (F) for indicating no decoding data in RAM 115. Thus the process proceeds to step S2 to continue the execution of receiving and recording image data.

FIG. 6 is a flowchart showing the recording process for one line at step S6 and step S10 in FIG. 5.

When the start of recording one line is instructed, the process proceeds to step S21 to examine whether the flag (F) for indicating no decoding data is on or off. If the flag (F) is off, the process proceeds to step S23 to set n=5.

Then the process proceeds to step S24 to convey ink sheet 14 for a fraction 1/n line and subsequently at step S25, to convey recording sheet 11 for one line (1/15.4 mm). Next, the process proceeds to step S26 to energize one block of the heat generating resistor body 132 of thermal head 13. Then at step S27, thermal head 13 is examined to determine whether or not the entire blocks of heat generating resistor 132 have been energized. If the entire blocks have not been energized as yet, the process proceeds to step S29 to wait until the time required for energizing (approximately 600 μs) has elapsed, and returns to the step S26 to execute energizing of the next block.

In this respect, thermal head 13 is divided into four blocks (n=4) for driving, and the time required for recording one line is approximately 2.5 ms (600 μs×4 blocks). Then at the step S27, when all of the blocks (four blocks) of thermal head 13 are completely energized to record the one-line portion, the process proceeds to step S28 to turn off the flag (F) for indicating no decoding data and returns to the original routine.

Hence, according to the present embodiment, while performing an image recording by receiving the image data for each unit of block (several lines), it is possible to effectively prevent the appearance of white stripes between the blocks of images which have been formed as well as the lowering of image density at the leading end of a block by increasing the amount by which the ink sheet is conveyed against the recording sheet for recording at the time of recording the initial line of the next block subsequent to having recorded the last line of the preceding block.

In the present embodiment, when buffer memory 112 becomes full, the image data stored in buffer memory 112 is sequentially recorded, but the present invention is not limited to this. For example, in the case of recording several lines in succession at a time, image recording may also be performed each at a time whenever such several lines are received and stored.

Figure 7:
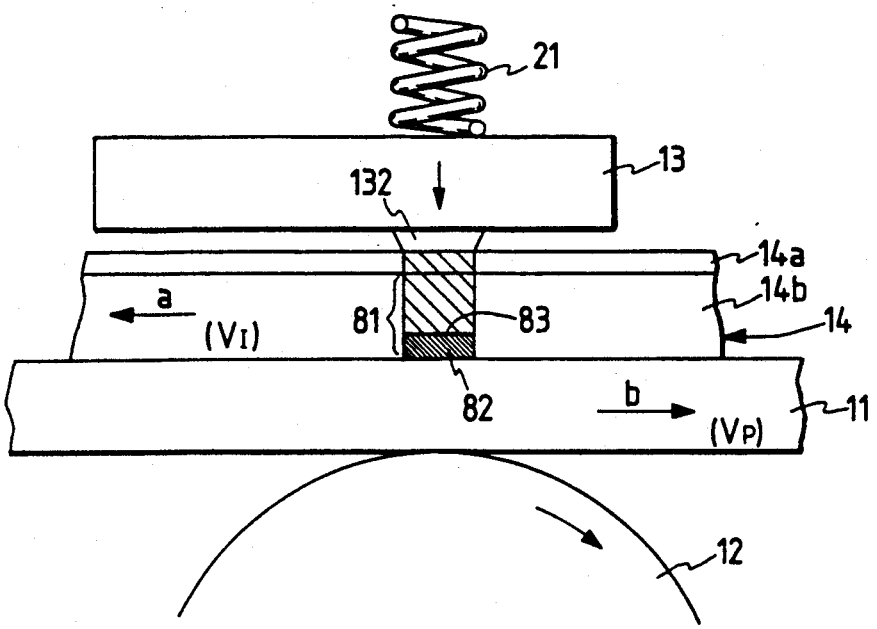
FIG. 7 is a view showing the state of recording sheet and ink sheet at the time of multiprinting according to the present embodiment.

Description of Recording Principle (FIG. 7)

FIG. 7 is a view showing a state of image recording when an image is recorded with recording sheet 11 and ink sheet 14 being conveyed in the opposite direction using a multiprint ink sheet.

As shown in the figure, recording sheet 11 and ink sheet 14 are pinched between platen roller 12 and thermal head 13. The thermal head 13 is pressurized by spring 21 under a given pressure against platen roller 12. Here, recording sheet 11 is conveyed by the rotation of platen roller 12 at a speed VP in the direction indicated by an arrow b. Meanwhile, ink sheet 14 is conveyed by the rotation of motor 25 for conveying ink sheet at a speed $V_I$ in the direction indicated by an arrow a.

Now, when the heat generating resistor 132 of thermal head 13 is heated by current from power source 105, the portion 91 of ink sheet 14 indicated by slashed lines is heated. Here numeral 14*a* denotes the base film of ink sheet 14; and 14*b* is the ink layer of ink sheet 14. When heat generating resistor 132 is energized, ink in the heated ink layer 91 is melted, and a portion thereof indicated by numeral 92 is transferred onto recording sheet 11. This portion 92 of the ink layer to be transferred is almost equivalent to a fraction 1/n of the portion of the ink layer indicated by a numeral 91.

Figure 8:
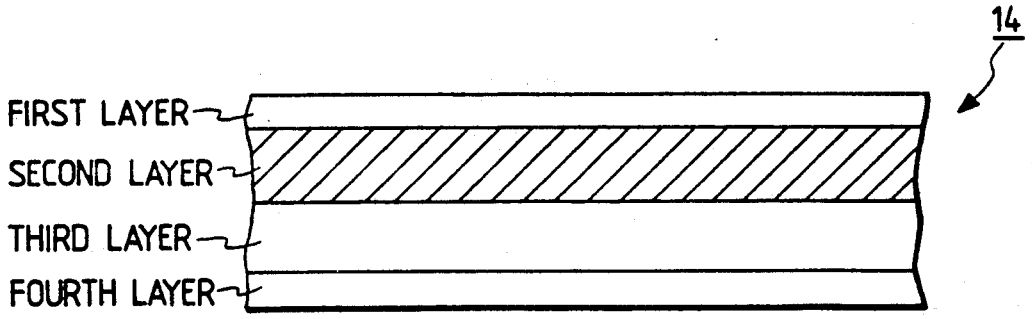
FIG. 8 is a cross-sectional view showing the multiink sheet used in the present embodiment.

Description of Ink Sheet (FIG. 8)

FIG. 8 is a cross-sectional view of ink sheet used for a multiprint according to the present embodiment. Here the ink sheet comprises four layers.

First, a second layer is made from a base film which is a member to support ink sheet 14. In the case of multiprint, since heat energy is applied repeatedly to a same location, it is advantageous to use a highly heat resistive aromatic polyamide film or condenser paper, but conventional polyester film can also be used. Although the film should be as thin as possible for a better printing quality from the viewpoint of its role as a medium, the thickness of 3–8 μm is desirable from the viewpoint of the strength required.

A third layer is the ink layer containing an amount of ink capable of being transferred onto recording paper (recording sheet) repeatedly for n times. The components thereof are resin such as EVA, etc. as adhesive, carbon black and nigrosine dye for coloring agent, and carnauba wax, paraffin wax, etc. for binding agent. These elements are appropriately mixed as principle components to enable the layer to withstand a repeated application at a same location for n times. It is desirable to coat this layer in an amount of 4–8 g/m$^2$. However, as its sensitivity and density differ depending on the coating amount, such amount can arbitrarily be selected.

A fourth layer is the top coating layer to prevent ink in the third layer from being transferred by pressure to the recording sheet at a location where no printing is performed. This layer comprises transparent wax, etc. Thus, the fourth layer which is transparent is the only portion to be transferred by pressure, and this prevents the recording sheet from being stained. A first layer is the heat resistive coating layer to protect the second layer which is the base film from the heat of thermal head 13. This is suited for the multiprint for which heat energy for n lines is often applied to a same portion (when black information continues), but its application is arbitrarily selective. Also, this is effectively applicable to a base film with comparatively low heat resistivity such as polyester film.

In this respect, the composition of ink sheet 14 is not limited to the present embodiment. For example, the ink sheet can also be formed with a base layer and a porous ink retaining layer containing ink which is provided at one end of the base layer, or having a fine porous netting structure provided on the base film to contain ink. Also, as the materials for base film, for example, film or paper comprising polyamide, polyethylene, polyester, polyvinyl chloride, triacethylene cellulose, nylon, etc. can be used. Further, although a heat resistive coating is not necessarily required, its material may also be for example, silicon resin, epoxy resin, fluorine resin, etholocellulose, etc.

Also, as an example of ink sheet containing heat sublimating ink, there is an ink sheet in which a coloring layer containing spacer particles and dye comprising guanamine resin and fluorine resin is formed on a substrate comprising polyethylene terephtharate, aromatic polyamide film, etc.

Also, a heating method in thermal transfer printer is not limited to the thermal head method using the aforesaid thermal head. The heating method using, for example, a current-carrying or laser transfer may also be employed.

Also, in the present embodiment, the description has been made of an example in which the thermal line head is used, but the application is not limited to this. A thermal transfer printer of so-called serial type may also be employed.

Also, the recording medium is not limited to a paper recording sheet. Any material which is capable of accepting ink transfer, cloth, plastic sheet or the like can be used as a recording medium.

Also, in each of the aforesaid embodiments, the description has been made of a facsimile apparatus. The present invention, however, is not limited to such application. It can also be applicable, for example, to word processors, typewriters or copying machines, etc.

In addition, the ink sheet is not limited to the rolled type as shown in the embodiments. It is also possible to employ, for example, an ink sheet contained in a housing which can detachably installed in the main body of recording apparatus, i.e., the so-called ink sheet cassette type, etc. whereby such housing containing the ink is detachably mounted as it is in the main body of the recording apparatus. Also, the ink sheet may be conveyed by taking up ink sheet 14 with the rotation of ink sheet winding roller 18.

Hence, according to the present embodiment, if the temperature of thermal head is lowered or the white stripes appear at the time of starting to record a block, the amount of conveyance of the ink sheet against the recording sheet is increased in order to increase the amount of ink to be molten or sublimated. As a result, it is possible to prevent the lowering of image density or the appearance of white stripes.

As set forth above, according to the present invention, there is an effect that the white stripes and the lowered density of recorded image can be prevented by increasing the conveyance amount of the ink sheet relative to recording medium at the time of starting the next recording when the time interval between the recordings is prolonged.

What is claimed is:

1. A thermal transfer recording apparatus for transferring an ink contained on an ink sheet onto a recording medium to record an image on said recording medium, comprising:

conveying means for relatively conveying said ink sheet and said recording medium;

recording means for recording on said recording medium using said ink sheet; and control means for controlling to make a conveyance amount by which said ink sheet is conveyed at a time of starting a recording operation large if the recording operation has been suspended after a predetermined quantity of an image data has been recorded by said recording means.

2. An apparatus according to claim 1, wherein said ink sheet and said recording medium are conveyed in opposite directions.

3. An apparatus according to claim 1, wherein the conveyance amount by which said ink sheet is conveyed is less than a length by which said recording medium is conveyed.

4. An apparatus according to claim 1, wherein said ink disposed at a given location on said ink sheet can be transferred from said given location onto said recording medium plural times.

5. An apparatus according to claim 1, wherein said recording means has a width of one line.

6. An apparatus according to claim 1, further comprising memory means for storing said predetermined quantity.

7. A thermal transfer recording apparatus for transferring an ink contained on an ink sheet onto a recording medium to record an image on said recording medium, comprising:

ink sheet conveying means for conveying said ink sheet by a conveyance amount;

recording medium conveying means for conveying said recording medium;

recording means for recording on said recording medium using said ink sheet; and control means for controlling so that a predetermined quantity of an image data is recorded and for controlling said ink sheet conveying means so as to make the conveyance amount large at a time of starting a next recording operation if the recording operation has been suspended after said predetermined quantity of said image data has been recorded.

8. An apparatus according to claim 7, wherein said ink disposed at a given location on said ink sheet can be transferred from said given location onto said recording medium plural times.

9. An apparatus according to claim 7, wherein said recording means has a width of one line.

10. An apparatus according to claim 7, further comprising memory means for storing said predetermined quantity.

11. A facsimile apparatus using a thermal transfer recording apparatus for transferring an ink contained on an ink sheet onto a recording medium to record an image on said recording medium, comprising:

ink sheet conveying means for conveying said ink sheet by a conveyance amount;

recording medium conveying means for conveying said recording medium;

decoding means for decoding a received image signal to produce a decoded signal at each time when a predetermined quantity of said image signals is received;

recording means for recording in accordance with the decoded signal on said recording medium using said ink sheet being conveyed by said ink sheet conveying means at each time when the predetermined quantity of image signals are received; and a controlling means for controlling recording so that a predetermined quantity of image data is recorded and for controlling said ink sheet conveying means so as to make the conveyance amount large at a time of starting a next recording operation if the recording operation has been suspended after said predetermined quantity of said image data has been recorded.

12. A facsimile apparatus according to claim 11, wherein said conveyance amount of said ink sheet is less than a length by which said recording medium is conveyed.

13. An apparatus according to claim 11, wherein said ink disposed at a given location on said ink sheet can be transferred from said given location onto the recording medium plural times.

14. An apparatus according to claim 11, wherein said recording means has a width of one line.

15. An apparatus according to claim 11, further comprising memory means for storing said decoded signals.

16. A thermal transfer recording method for recording by applying thermal energy with a recording head to transfer an ink contained on an ink sheet onto a recording medium to record an image on said recording medium, said method comprising the steps of:

inputting an image data into a memory;

supplying continuously said image data as an image signal to said recording head when a predetermined quantity of said image data has been input into said memory;

determining whether said image signal is being continuously supplied to said recording head;

conveying said ink sheet and the recording medium relative to said recording head by a predetermined conveyance amount when said image signal is continuously supplied to said recording head;

increasing the conveyance amount of said ink sheet at said conveying step when said image signal is not continuously supplied to said recording head; and transferring said ink from said ink sheet to said recording medium by causing said recording head to generate heat in response to said image signal to be supplied to said recording head.

17. A method according to claim 16, wherein said ink disposed at a given location on said ink sheet can be transferred from said given location onto said recording medium plural times.

18. An method according to claim 16, wherein said recording means has a width of one line.

* * * * *

UNITED STATES PATENT AND TRADEMARK OFFICE

CERTIFICATE OF CORRECTION

PATENT NO. : 5,184,151

DATED : February 2, 1993

INVENTOR(S) : TAKESHI ONO, ET AL.

It is certified that error appears in the above-identified patent and that said Letters Patent is hereby corrected as shown below:

On the title page:

IN [56] REFERENCES CITED

Under FOREIGN PATENT DOCUMENTS:
"6258917 1/1983 Japan" should read
--62-58917 12/1987 Japan--.

COLUMN 1

Line 21, "such" should be deleted.
Line 68, "there is" should be deleted.

COLUMN 2

Line 4, "for" should read --far--.
Line 16, "mead" should read --head--.
Line 19, "lower" should read --lowered--.
Line 30, "increase" should read --to cause an increase in the--.

COLUMN 5

Line 22, "an" should be deleted.
Line 23, "the" (second occurrence) should be deleted.
Line 26, "transmit" should read --transmitting--.
Line 29, "conveying" should read --conveying the--.
Line 39, "by" should read --by the--.
Line 54, "ink" should read --the ink--.
Line 55, "conveying" should read --conveying the--.
Line 56, "convey" should read --convey the--.
Line 61, "number." should read --numbers.--.

UNITED STATES PATENT AND TRADEMARK OFFICE

CERTIFICATE OF CORRECTION

PATENT NO. : 5,184,151

DATED : February 2, 1993

INVENTOR(S) : TAKESHI ONO, ET AL.

It is certified that error appears in the above-identified patent and that said Letters Patent is hereby corrected as shown below:

COLUMN 6

Line 9, "adjust" should read --adjusts--.
Line 37, "conveying" should read --conveying the--.
Line 38, "conveying" should read --conveying the--.
Line 39, "discharging" should read --discharging the--.

COLUMN 7

Line 5, "a" should be deleted.
Line 6, "for" should read --for a--.
Line 7, "towards same" should read --towards discharge sheet rollers (16a and 16b) and at the same--.
Line 12, "the" should read --and the--.
Line 17, "a" should be deleted.
Line 18, "process" should read --the process--.
Line 19, "the" should be deleted.
Line 41, "the" should be deleted and "process" should read --the process--.

COLUMN 8

Line 8, "the" should be deleted.
Line 64, "of" should read --of an--.

COLUMN 10

Line 11, "can" should read --can be--.
Line 12, "recording" should read --the recording--.
Line 19, "of" should read --of the--.
Line 30, "to" should read --to the--.
Line 45, "large" should read --larger--.

UNITED STATES PATENT AND TRADEMARK OFFICE

CERTIFICATE OF CORRECTION

PATENT NO. : 5,184,151

DATED : February 2, 1993

INVENTOR(S) : TAKESHI ONO, ET AL.

It is certified that error appears in the above-identified patent and that said Letters Patent is hereby corrected as shown below:

COLUMN 11

Line 10, "large" should read --larger--.
Line 44, "large" should read --larger--.

COLUMN 12

Line 43, "An" should read --A--.

Signed and Sealed this

Thirty-first Day of May, 1994

Bruce Lehman

*Attest:*

BRUCE LEHMAN

*Attesting Officer*

*Commissioner of Patents and Trademarks*